US011801877B1

(12) United States Patent
Balke

(10) Patent No.: US 11,801,877 B1
(45) Date of Patent: Oct. 31, 2023

(54) RAILCAR ANT-SCISSORING SYSTEM

(71) Applicant: Rodney W. Balke, Colleyville, TX (US)

(72) Inventor: Rodney W. Balke, Colleyville, TX (US)

( * ) Notice: Subject to any disclaimer, the term of this patent is extended or adjusted under 35 U.S.C. 154(b) by 369 days.

(21) Appl. No.: 17/101,869

(22) Filed: Nov. 23, 2020

(51) Int. Cl.
*B61G 5/02* (2006.01)
*B61G 3/26* (2006.01)
*B61G 3/24* (2006.01)

(52) U.S. Cl.
CPC ..... *B61G 5/02* (2013.01); *B61G 3/24* (2013.01); *B61G 3/26* (2013.01)

(58) Field of Classification Search
CPC ... B61G 3/00; B61G 3/22; B61G 3/24; B61G 3/26; B61G 3/28; B61G 3/30; B61G 5/00; B61G 5/02; B61G 5/04
USPC ..... 213/149
See application file for complete search history.

(56) References Cited

U.S. PATENT DOCUMENTS 494,424 A * 3/1893 Jenkins ..... B61G 3/16 213/97
990,042 A * 4/1911 Haley ..... B61G 5/08 285/63
1,319,311 A * 10/1919 Tomlinson ..... B61G 5/10 213/76
3,774,777 A * 11/1973 Monzi ..... B61G 1/32 213/100 W
4,232,793 A * 11/1980 Hallam ..... B61G 7/12 213/43
7,059,458 B2 * 6/2006 Borg ..... B60R 21/38 293/133

FOREIGN PATENT DOCUMENTS

FR 2805323 A1 * 8/2001 ..... B61G 11/12

* cited by examiner

*Primary Examiner* — S. Joseph Morano
*Assistant Examiner* — Cheng Lin
(74) *Attorney, Agent, or Firm* — Kenneth L. Tolar

(57) ABSTRACT

A railcar anti-scissoring system includes a base controller positioned within a train locomotive that sends a launch initiation command to railcar-stabilizing units when detecting rapid deceleration indicative of a collision or derailment. The stabilizing units include a receiver secured to the rear end of each rail car and a coupling unit attached to the front end of each rail car. The coupling unit houses a deployable locking rod that is thrust into a mating cavity in the receiver upon receipt of the launch command. The deployed locking rod maintains the host railcar and the preceding railcar in a linear orientation during a rapid deceleration to prevent jackknifing.

13 Claims, 8 Drawing Sheets

RAILCAR ANT-SCISSORING SYSTEM

CROSS REFERENCE TO RELATED APPLICATIONS

None.

BACKGROUND OF THE INVENTION

The present invention relates to a uniquely designed system that prevents railcars from jackknifing during a collision or a derailment.

DESCRIPTION OF THE PRIOR ART

Train accidents are typically caused when the engine car collides with other objects or when one or more cars derail. During an accident or derailment, the train decelerates rapidly, causing the cars to jackknife and collapse against each other. The resulting pileup often damages the cars, their contents and nearby infrastructure. If a freight railcar is transporting hazardous materials, the material can be released, threatening the environment, local inhabitants and nearby wildlife. Environmental cleanups of areas where toxic materials are released can last years and cost millions of dollars.

If a passenger train derails, jackknifing railcars can kill or severely injure a multitude of people. The resulting injuries and death can expose the operator to substantial and crippling damage awards in lawsuits filed by injured passengers and their relatives.

Accordingly, there is currently a need for device that prevents railcars from jackknifing during collisions or derailments. The present invention addresses this need by providing an automated system that deploys external locking rods on one railcar into receivers on a leading railcar to maintain the cars in a linear orientation during a rapid deceleration.

SUMMARY OF THE INVENTION

The present invention relates to a railcar anti-scissoring system comprising a base controller positioned within a train locomotive. The controller sends a launch initiation command to railcar-stabilizing units when detecting rapid deceleration indicative of a collision or derailment. The stabilizing units include a receiver secured to the rear end of each rail car and a coupling unit attached to the front end of each rail car. The coupling unit houses a deployable locking rod that is thrust into a mating cavity in the receiver upon receipt of the launch command. The deployed locking rod maintains the host railcar and the preceding railcar in a linear orientation during a rapid deceleration to prevent jackknifing.

It is therefore an object of the present invention to provide an anti-scissoring system that prevents railcars from jackknifing during collisions or derailments.

It is therefore another object of the present invention to provide an anti-scissoring system for railcars that automatically initiates upon rapid deceleration of a train.

It is yet another object of the present invention to provide an anti-scissoring system for railcars that is wirelessly initiated.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
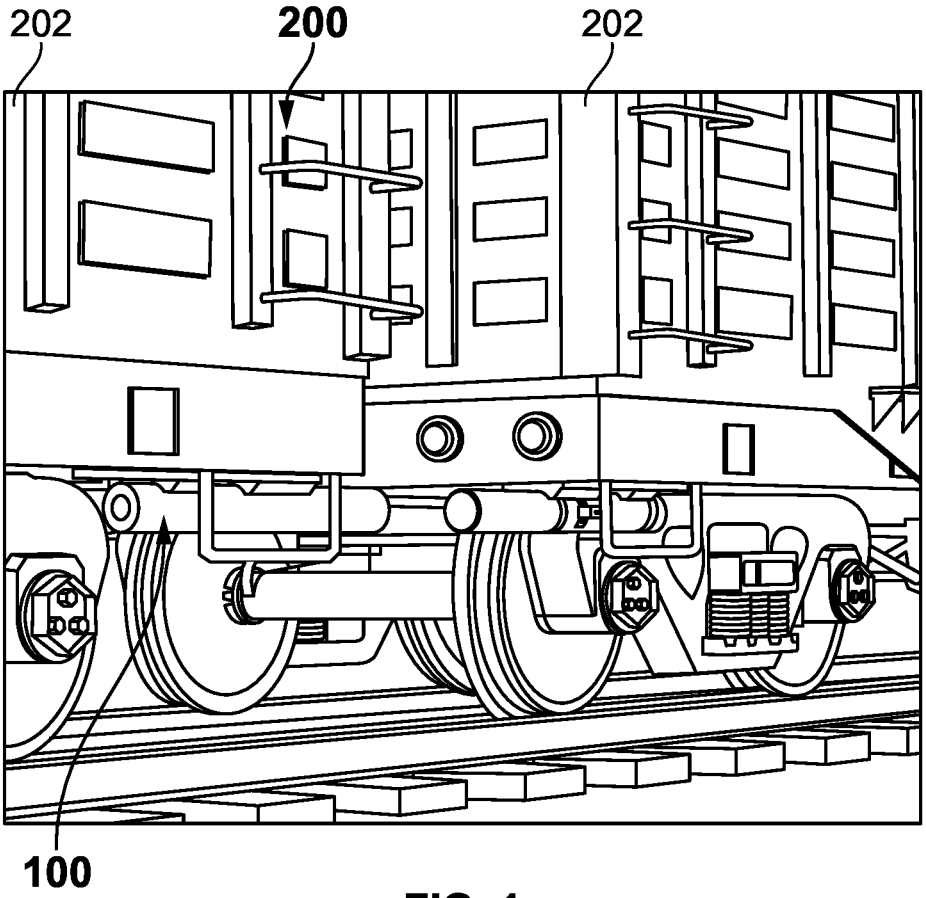
FIG. 1 depicts the anti-scissoring system according to the present invention installed on a pair of adjacent train cars.
Figure 2:
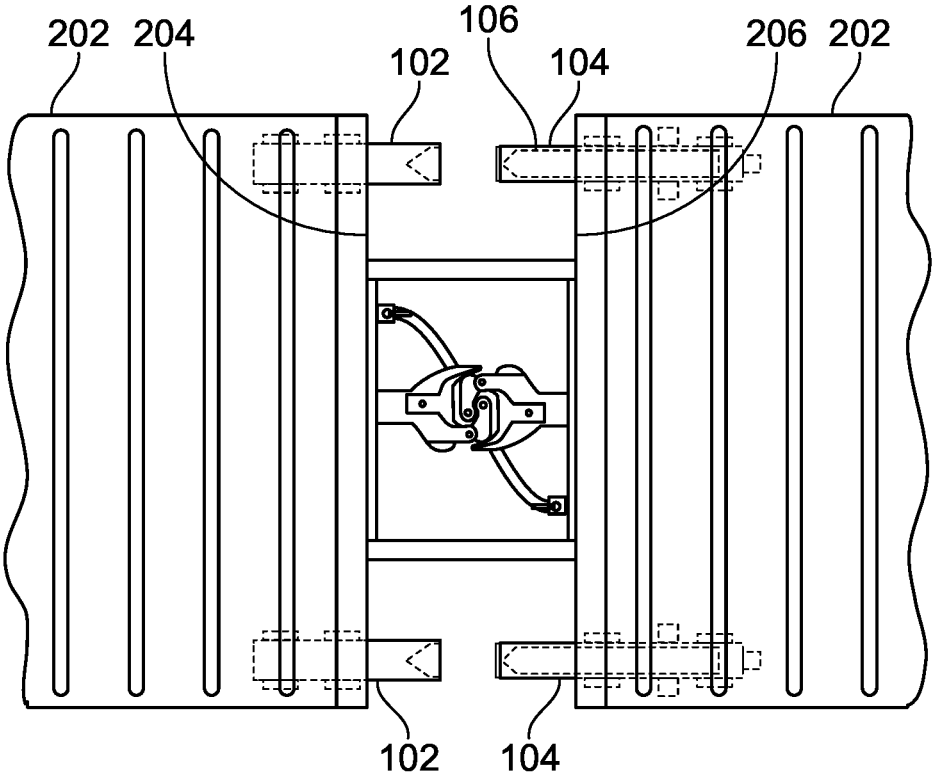
FIG. 2 is a top view of the railcars of FIG. 1.
Figure 3:
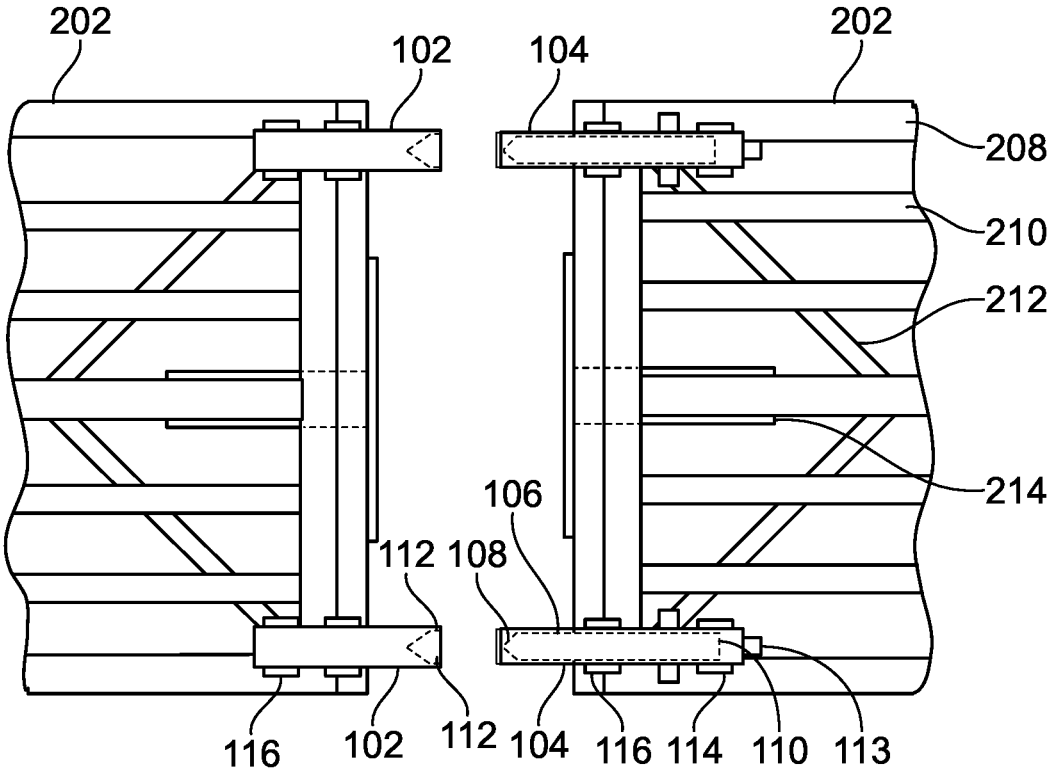
FIG. 3 is a bottom view of the railcars depicted in FIGS. 1 and 2.
Figure 4:
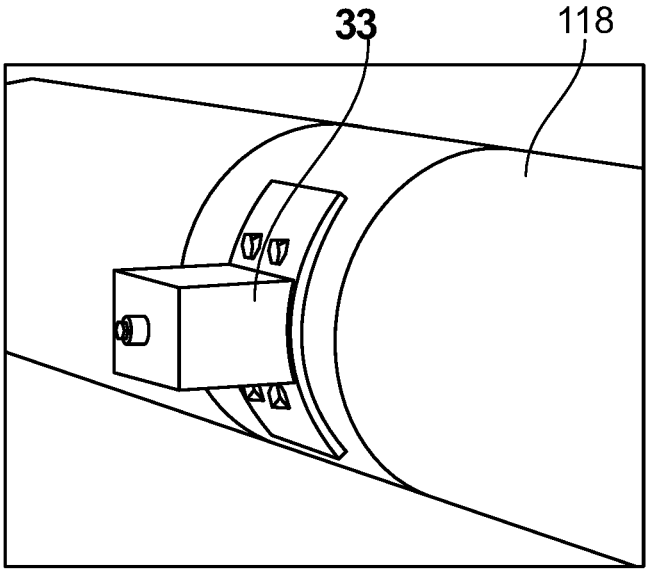
FIG. 4 is an isolated, perspective view of an exemplary coupling unit cylinder with a latch mounted thereon.
Figure 5:
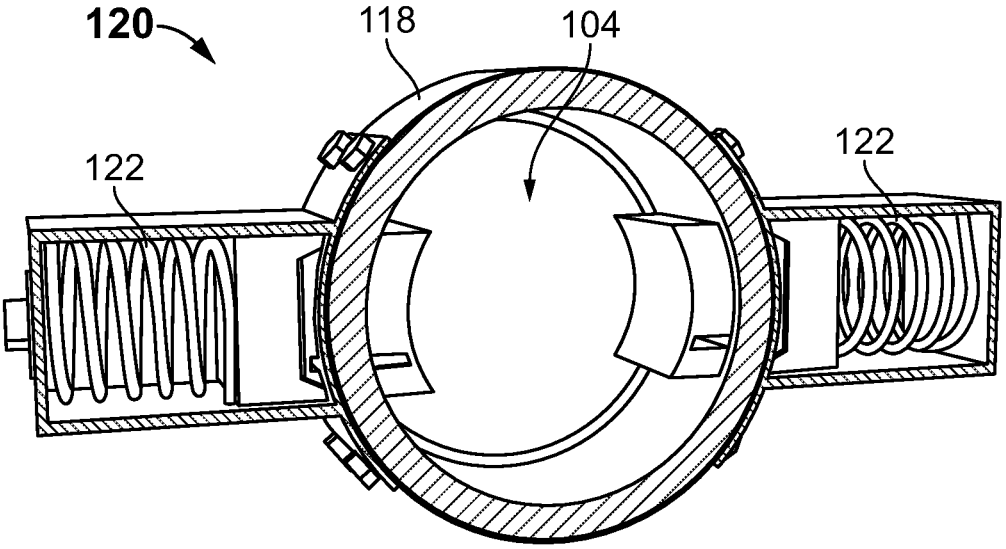
FIG. 5 is an isolated, side view of a latch.
Figure 6:
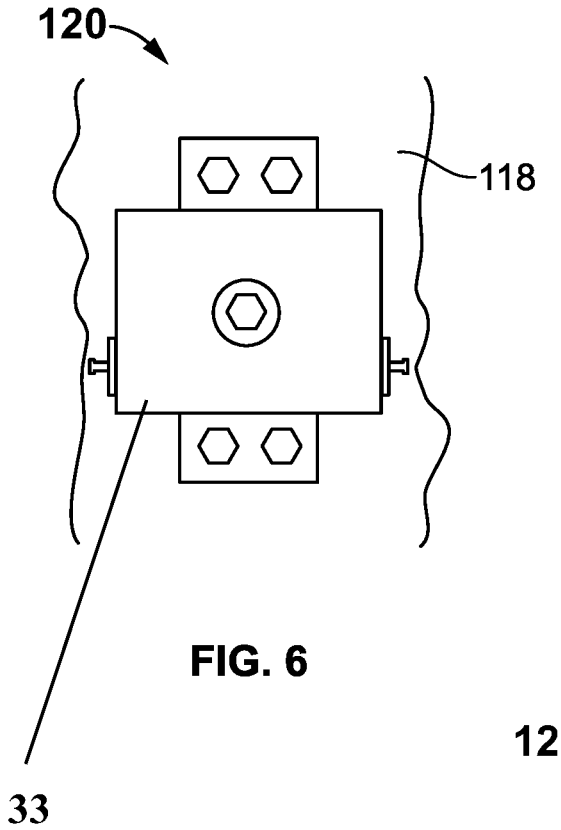
FIG. 6 is a top view of the latch of FIG. 5.
Figure 7:
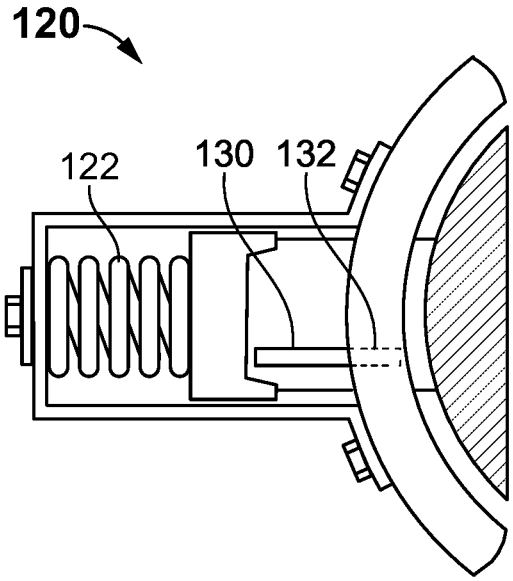
FIG. 7 depicts the latch in a retracted position.
Figure 8:
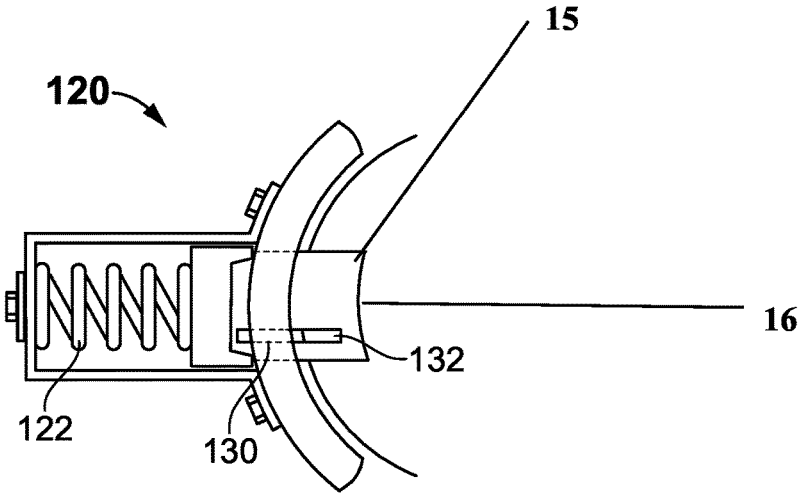
FIG. 8 depicts the latch in a deployed position.
Figure 9:
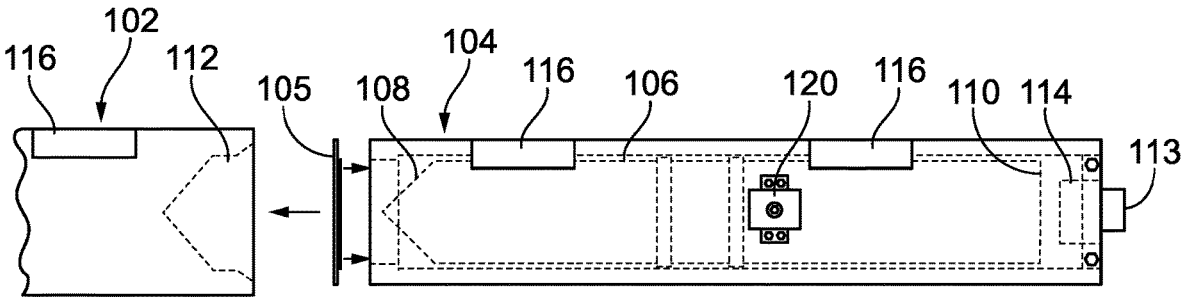
FIG. 9 depicts the locking rod in a retracted position.
Figure 10:
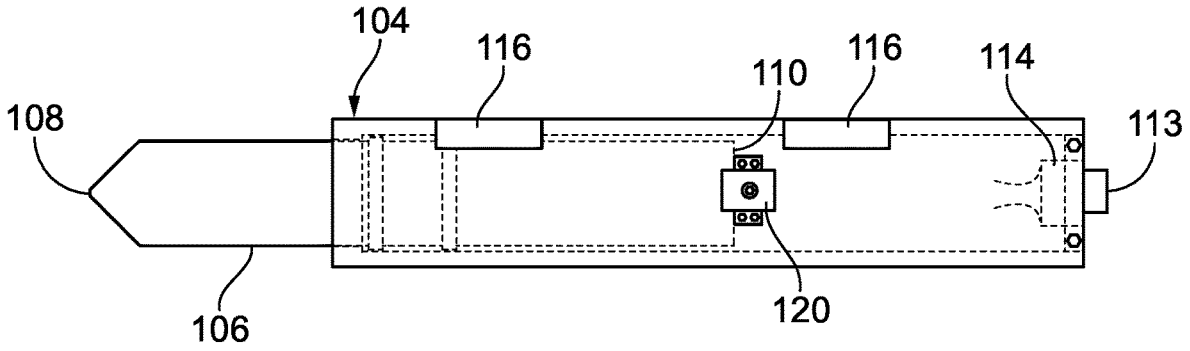
FIG. 10 depicts the locking rod in an extended position.
Figure 11:
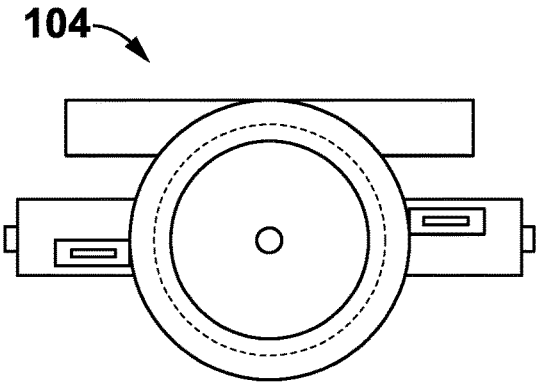
FIG. 11 is a front end view of the locking rod.
Figure 12:
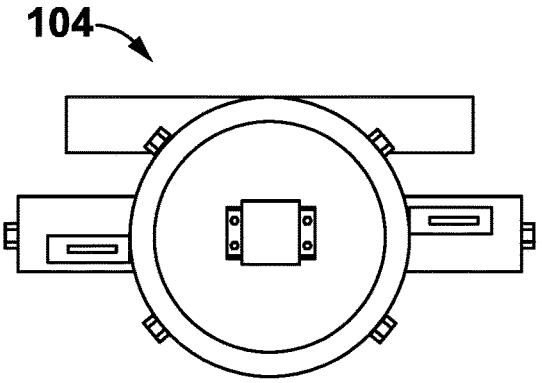
FIG. 12 is a rear-end view of the locking rod.
Figure 13:
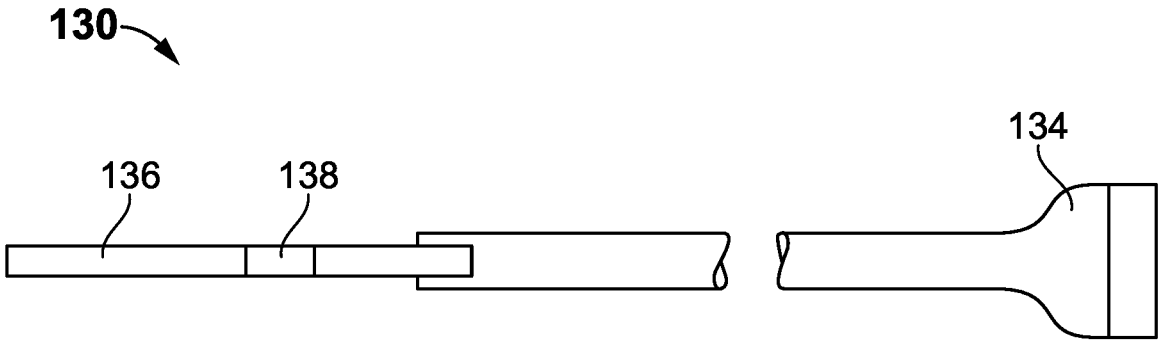
FIG. 13 is a top view of the latch-retraction tool.
Figure 14:
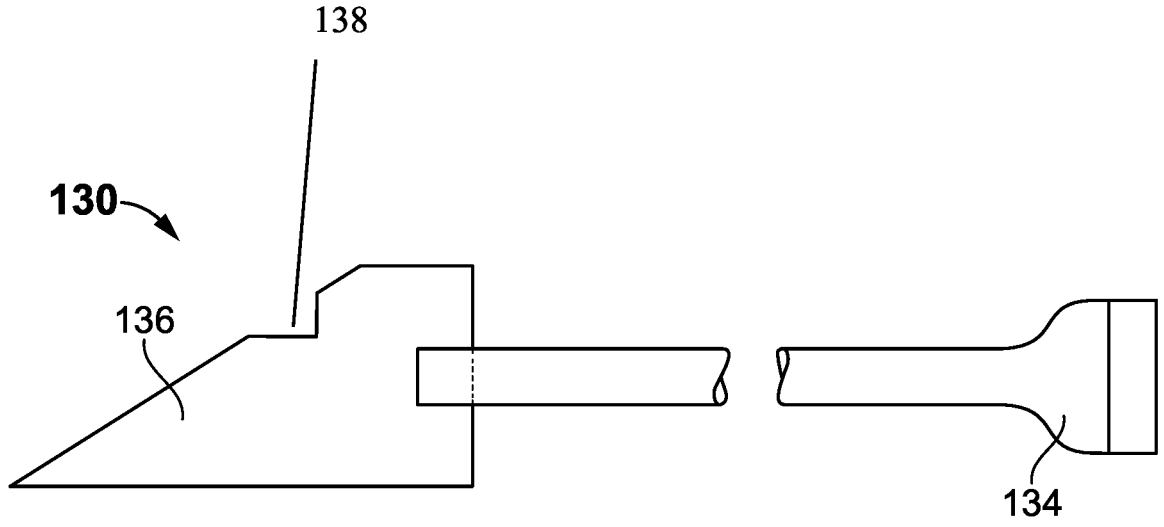
FIG. 14 is a side view of the latch-retraction tool.

The present invention relates to a railcar 202 anti-scissoring system 100 for a train 200 comprising a base controller positioned within a locomotive. The controller includes an accelerometer for detecting rapid train deceleration and a wireless transmitter that sends an initiation or launch command to railcar stabilizing units.

The stabilizing units include a pair of receivers 102 and a pair of coupling units 104 mounted on each railcar. The stabilizing units could be mounted on the side sill 208, floor stringers 210, diagonal braces 212 attached to a reinforced draft gear pocket 214, or any other suitable location. Welding flanges 116 isolate the heat from the units (102 and 104) and while enhancing the structural integrity of the system 100. The receiver 102 is secured to the rear end of a railcar undercarriage, near each side. The receiver 102 is a substantially solid, cylindrical rod having a closed front end and an open rear end with a conical cavity 112 formed therein. The cavity is dimensioned and configured to guide and receive a nosecone 108 on a deployable locking rod 106 described, infra.

The coupling unit 104 is attached to the front end 206 of each rail car undercarriage, near each side, and is axially aligned with the receiver. The coupling unit includes a hollow cylinder 118 having a closed rear end and an open front end. Received within the cylinder is a deployable, tubular locking rod 106 having a rear end 110 and a nosecone 108 at a forward end that is dimensioned and configured to firmly fit within the receiver cavity 112.

A discharge module within the cylinder interior is attached to the closed end for firing the locking rod 106 into the receiver cavity upon receiving the launch command. The discharge module includes a plastic enclosure containing a propellant 114, such as a mixture of sodium azide, potassium nitrate and an igniter, or a similar equivalent.

An electronics module 113 mounted on the cylinder exterior is electrically connected to the discharge module. The electronics module 113 includes a processor, a wireless communication module, and an igniter driver for activating the propellant upon receipt of the launch command from the base controller or an upstream coupling unit. The wireless communication module includes a transmitter in wireless communication with the base controller and the electronics modules on all succeeding or trailing railcars. Therefore, the launch command can be transmitted from the base controller to the leading railcar, which then relays the command to the next trailing railcar in a daisy-chain fashion.

The system could further include a software application that is loaded onto a smart phone, a mobile phone, a laptop, a tablet, or other suitable electronic handheld communication device. The application would allow a worker to communicate with the electronics module to identify any maintenance issues, depleted batteries, component failure, etc. The electronics module could also include an accelerometer in communication with the processor for detecting rapid railcar deceleration to initiate the launch command in the event the locomotive controller fails.

The cylinder further includes a latching mechanism 120 for anchoring the locking rod in the deployed position. The latching mechanism includes a casing 33 affixed to the outer surface of the cylinder. The casing encloses a spring-biased plunger 122 carrying a locking plate 15 that extends into the cylinder interior. A distal end 16 of the locking plate is arcuate to conform to the outer surface of the locking rod. The locking plate includes a slot 132 for receiving a retraction tool 130 when returning the locking rod to an original, stowed position. Each latch 120 has a shear strength of about 125,000 pounds when extended or about 250,000 pounds when 2 latches 120 are extended. An additional latch could be added if two are deemed ineffective. The propellant 114 has enough energy to easily thrust the locking rod 106 into the receiver even with the latches 120 firmly engaging the rod exterior.

The retraction tool 130 includes an elongated shaft having an impact member 134 at a first end and a triangular blade 136 at an opposing end. To retract the latches, end covers 105 are removed and a pointed end of the blade is inserted into the slot while a worker strikes the opposing end with a hammer or similar impact tool to drive the plate out of the cylinder and back into the casing, The blade includes a notch 138 that engages the plate 15 to limit the penetration depth of the blade.

Accordingly, when a train rapidly decelerates indicating a possible collision or derailment, the locomotive controller initiates a launch command to the leading railcar. The electronics module receives the signal and launches its locking rod into the preceding receiver. Simultaneously, the electronics module transmits a launch signal to the succeeding railcar, which deploys its locking rod.

As is readily apparent from the description above, the present invention provides a railcar anti-scissoring mechanism that prevents railcars from jackknifing during a train accident. However, the above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a train having a locomotive, a leading railcar and a trailing railcar, said leading railcar and said trailing railcar each having a front end and a rear end, an anti-scissoring system comprising:

a receiver mounted on the rear end of said leading railcar, said receiver having an open rear end with a cavity formed therein;

a coupling unit mounted on the front end of said trailing railcar, said coupling unit including a hollow cylinder having an open front end in communication with an interior chamber;

a deployable locking rod received within said cylinder, said locking rod having a forward end that is dimensioned and configured to firmly fit within said cavity;

means for deploying said locking rod from said cylinder and into said receiver upon deceleration of said train, wherein said means comprises a base controller positioned within said locomotive, said base controller including an accelerometer for detecting rapid train deceleration and a wireless transmitter that sends a launch command to said coupling unit.

2. The combination according to claim 1 wherein said means for deploying said locking rod from said cylinder and into said receiver upon deceleration of said train further comprises:

a discharge module containing a propellant adjacent said locking rod;

an electronics module electrically connected to the discharge module, said electronics module including a processor, a wireless communication module, and an igniter driver for activating the propellant upon receipt of the launch command from the base controller.

3. The combination according to claim 1 further comprising a latching mechanism for anchoring the locking rod in the deployed position.

4. The combination according to claim 3 wherein said latching mechanism comprises:

a casing affixed to an outer surface of said hollow cylinder;

a spring-biased plunger received within said casing and carrying a locking plate that extends into the interior chamber of said cylinder and engages said locking rod, whereby when said locking rod is deployed, said plate extends to a position behind said locking rod to prevent said locking rod from being forced back into said cylinder by said leading railcar.

5. The combination according to claim 4 wherein a distal end of the locking plate is configured to conform to the outer surface of the locking rod.

6. The combination according to claim 4 wherein said locking plate includes a slot for receiving a retraction tool when returning the locking rod to an original, stowed position.

7. The combination according to claim 6 wherein said retraction tool includes an elongated shaft having an impact member at a first end and a triangular blade at an opposing end for inserting into said slot while a worker strikes the first end with an impact tool to drive the plate out of the cylinder and back into said casing.

8. In combination with a train having a locomotive, a leading railcar and a trailing railcar, said leading railcar and said trailing railcar each having a front end and a rear end, an anti-scissoring system comprising:

a receiver mounted on the rear end of said leading railcar, said receiver having an open rear end with a cavity formed therein;

a coupling unit mounted on the front end of said trailing railcar, said coupling unit including a hollow cylinder having an open front end in communication with an interior chamber;

a deployable locking rod received within said cylinder, said locking rod having a forward end that is dimensioned and configured to firmly fit within said cavity;

means for deploying said locking rod from said cylinder and into said receiver upon deceleration of said train;

a latching mechanism for anchoring the locking rod in the deployed position, wherein said latching mechanism includes a casing affixed to an outer surface of said hollow cylinder; a spring-biased plunger received within said casing and carrying a locking plate that extends into the interior chamber of said cylinder and engages said locking rod, whereby when said locking rod is deployed, said plate extends to a position behind said locking rod to prevent said locking rod from being forced back into said cylinder by said leading railcar.

9. The combination according to claim 8 wherein said means for deploying said locking rod from said cylinder and into said receiver upon deceleration of said train comprises a base controller positioned within said locomotive, said base controller including an accelerometer for detecting rapid train deceleration and a wireless transmitter that sends a launch command to said coupling unit.

10. The combination according to claim 9 wherein said means for deploying said locking rod from said cylinder and into said receiver upon deceleration of said train further comprises:

a discharge module containing a propellant adjacent said locking rod;

an electronics module electrically connected to the discharge module, said electronics module including a processor, a wireless communication module, and an igniter driver for activating the propellant upon receipt of the launch command from the base controller.

11. The combination according to claim 8 wherein a distal end of the locking plate is configured to conform to the outer surface of the locking rod.

12. The combination according to claim 8 wherein said locking plate includes a slot for receiving a retraction tool when returning the locking rod to an original, stowed position.

13. The combination according to claim 12 wherein said retraction tool includes an elongated shaft having an impact member at a first end and a triangular blade at an opposing end for inserting into said slot while a worker strikes the first end with an impact tool to drive the plate out of the cylinder and back into said casing.

* * * * *